United States Patent [19]

Frederick

[11] 4,033,139

[45] July 5, 1977

[54] PILE DRIVING HAMMER, APPARATUS AND METHOD

[76] Inventor: Leonard L. Frederick, 15 Crestview Terrace, Whippany, N.J. 07981

[22] Filed: Aug. 28, 1975

[21] Appl. No.: 608,568

Related U.S. Application Data

[62] Division of Ser. No. 440,861, Feb. 8, 1974, Pat. No. 3,927,722.

[52] U.S. Cl. ..... 61/53.5; 173/DIG. 1; 175/6

[51] Int. Cl.[2] ..... E02D 7/10

[58] Field of Search ..... 61/46, 46.5, 53.5, 63; 175/6; 173/DIG. 1, 125, 127, 90, 91, 134, 139, 118

[56] References Cited

UNITED STATES PATENTS

| | | | |
|---|---|---|---|
| 2,904,964 | 9/1959 | Kupka | 173/134 X |
| 2,948,122 | 8/1960 | Smith | 173/131 |
| 3,009,522 | 11/1961 | Bedner | 173/125 |
| 3,178,892 | 4/1965 | Stimson | 61/46.5 |
| 3,502,159 | 3/1970 | Pogonowski | 61/53.5 X |
| 3,524,322 | 8/1970 | Pogonowski | 61/53.5 X |
| 3,646,598 | 2/1972 | Chelminski | 173/91 X |
| 3,747,689 | 7/1973 | Frederick | 173/90 |
| 3,754,403 | 8/1973 | Mott et al. | 61/53.5 |
| 3,860,122 | 1/1975 | Cevnosek | 173/90 X |
| 3,881,557 | 5/1975 | Gendron et al. | 173/DIG. 1 |

*Primary Examiner*—Dennis L. Taylor
*Attorney, Agent, or Firm*—Edwin E. Greigg

[57] ABSTRACT

What follows is a description of a unique hammer for driving pile members onshore or offshore, an apparatus for driving pile members offshore, and a method of driving a pile member.

The hammer includes a displaceable ram structure which is reciprocated by a pressurized working fluid against a pile member-engaging anvil structure. The anvil structure is preloaded by a quantity of fluid compressed by the ram structure in the course of its impact delivering displacement. This preload causes the anvil structure to also be displaced in the impact delivering direction, but at a lower rate than the ram structure.

The method provides for directing a pressurized working fluid in a first direction to load a ram structure, directing a portion of this pressurized working fluid further in the first direction in order to decelerate the movements of the ram structure in the loading direction, to direct another portion of the pressurized working fluid in a second direction for producing a firing of the ram structure, and to preload an anvil structure utilizing the firing mode of the ram structure in order to cause the anvil structure to be displaced in the firing direction, but at a slower rate than the ram structure.

For driving a pile member from an offshore installation, a conduit structure is provided into which the pile member, the hammer and a supporting structure for the hammer are inserted and displaced in the course of driving the pile member. In addition to the method mentioned above, when driving a pile member from an offshore installation, the water immediately surrounding the area at which the anvil structure engages the pile member, is displaced.

26 Claims, 14 Drawing Figures

86
84
264
238
208
226
36
38
18
20
16
212
34
42
210
40
230
136
44
232
10
142
32
14
140
22
114
24
126
92
30
128
144
214
138
154
160
162
152
166
164
230
190
168
148
192
158
170
26
156
150
194
172
28
174
186
184
178
188
176
180
182
12

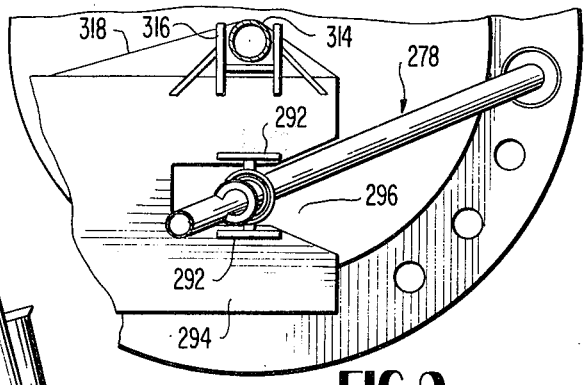
FIG. 9
FIG. 8
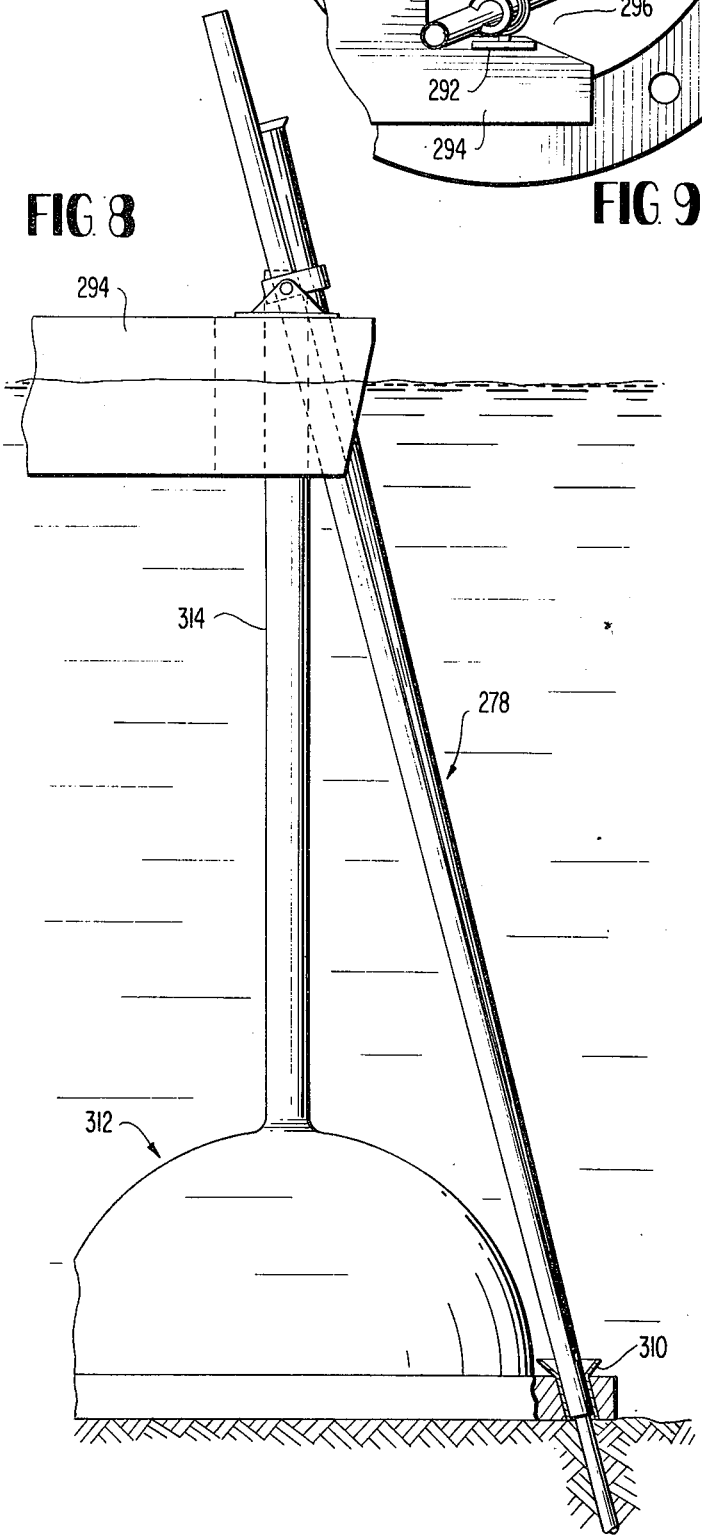
FIG. 6
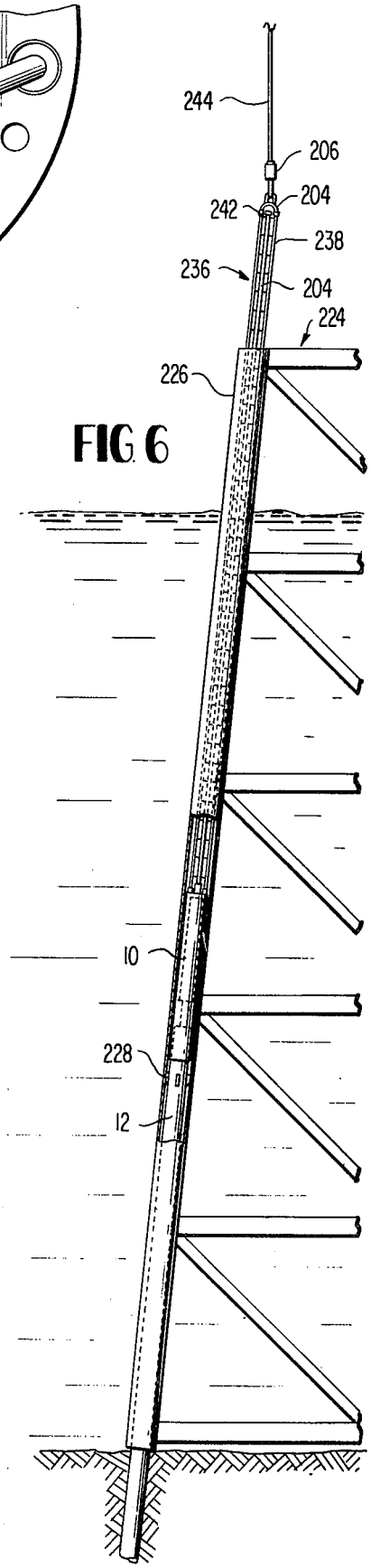

204
242
236
264
280
238
208
278
290
292
7a
10
284
282
286
280
288
7b
306
294
7c
308
298
304
296
302
300
7d
226
310
12

PILE DRIVING HAMMER, APPARATUS AND METHOD

This is a division of application Ser. No. 440,861, filed Feb. 8, 1974 now U.S. Pat. No. 3,927,722.

BACKGROUND OF THE INVENTION

1. Field of the Invention

The present invention relates to the field of equipment for driving a pile member, and more particularly to a hammer for driving a pile member and to a method for producing a reciprocating impact load against a pile member, and moreover to a method for producing a reciprocating impact load against a pile member, which is to be driven from an offshore installation.

In the pile driving equipment field, as in many other fields, there is always a need for equipment which has a high degree of adaptability. For example, it is more desirable to have a pile driving hammer which functions just as effectively in driving a pile member from an offshore installation as it does in driving a pile member on land, than it is to have a pile driving hammer which is more effective in one mode of operation than in the other, thus possibly requiring different pile driving hammers.

It would therefore be desirable to those in the pile driving equipment art, to have available to them a pile driving hammer which is highly adaptable, for example, which can be utilized just as effectively in driving pile members at onshore as well as offshore sites. The present invention fulfills such a need.

Also important to those interested in the field of pile driving equipment are reliability and efficiency. A pile driving hammer which has a high downtime due to wear, maintenance and the like, is quite naturally undesirable. Just as undesirable is a pile driving hammer which does not have a high rated striking force. Accounting for these deficiencies results in higher costs with a consequent reduction in competitiveness.

It would therefore be desirable to those in the pile driving equipment art to have available to them a pile driving hammer which has a low downtime and which provides a high rated striking force. The present invention provides such a pile driving hammer.

2. Description of the Prior Art

I am aware of two recently issued patents to Steven V. Cherminski relating to a pile driving hammer and method which warrant comment. These are U.S. Pat. No. 3,714,789, issued on Feb. 6, 1973 and U.S. Pat. No. 3,788,402, issued Jan. 29, 1974. The hammer disclosed in these patents includes in its essential elements a piston assembly, a cylinder bottom, a bounce chamber, defined between the piston assembly and the cylinder bottom, a pressurized driving fluid storage chamber formed in the cylinder bottom, a release valve, which controls communication between the bounce chamber and the storage chamber, and a pile driving adapter. There are five different modes of operation disclosed in these patents, all of which include energizing the bounce chamber from the storage chamber in order to displace the piston assembly away from the cylinder bottom, with one of these modes including preloading and impacting. However, it should be noted that in this mode, as in the other modes, there is no displacement of the anvil structure before impacting. It is doubtful that such a system, which is structurally and functionally different from the present invention, with the problem of metal fatigue, which inevitably would result from the mode described, would provide the state of the art with an answer to the needs expressed above.

OBJECTS AND SUMMARY OF THE INVENTION

It is, therefore, a general object of the present invention, to provide the present state of the art with a unique pile driving hammer which satisfies the needs expressed above.

It is a related general object of the present invention to provide a method of producing a reciprocating impact load against a pile member by a fluid-actuated pile driving hammer which satisfies the needs expressed above.

It is another and more specific object of the present invention to provide a pile driving hammer comprising a combination of functionally interrelated elements which define a separate loading chamber and firing chamber which alternately receive a pressurized working fluid for the purpose of first loading and thereafter firing a ram element of the hammer in a repeating fashion to impart both a preload and impact load to a pile-engaging anvil structure.

It is a related specific object of the present invention to provide a pile driving hammer in which the generated preload causes the anvil structure to move relative to and in a direction away from the ram structure before it is impacted.

It is still another specific object of the present invention to provide a pile driving hammer with a unique conduit means and valving means for dispensing the pressurized working fluid within the hammer in order to affect an operating cycle for the hammer.

It is yet another specific object of the present invention to provide the existing state of the art with an apparatus for driving a pile member from an offshore installation.

It is yet another related specific object of the present invention to provide the existing state of the art with a pile driving hammer which satisfies the needs mentioned above and which is adaptable for use in an apparatus for driving a pile member from an offshore installation, wherein the hammer can be operated below the surface of the water in order to drive the pile member.

These and other objects are accomplished according to the present invention by the provision of a pile driving hammmer which includes a pile member-engaging anvil structure, a ram structure, which is utilized to develop a preload against the anvil structure and to thereafter impact against the anvil structure, and a piston structure which includes conduit means and valving means. The ram structure defines an internal space into which a portion of the piston structure is received for defining with the ram structure a loading chamber and a firing chamber. The valving means control the flow of pressurized working fluid from the conduit means alternatingly into the loading chamber and the firing chamber to effect the necessary loading and firing of the ram structure toward the anvil structure.

These and other objects are also accomplished according to the present invention by the provision of a method of producing a reciprocating impact load against a pile member by a fluid-actuated pile driving hammer in which a pressurized working fluid is directed in alternating opposite direction within the impacting structure in order to produce reciprocation of the impacting structure, the impacting structure serving also to initially preload a pile member-engaging anvil structure prior to impact, in order to move the anvil structure in the direction of impact.

These and other objects are also accomplished according to the present invention by the provision of an apparatus for driving a pile member from an offshore installation, where the apparatus can be effectively used below the surface of the water.

BRIEF DESCRIPTION OF THE DRAWINGS

FIG. 6 is a schematic illustration of an apparatus according to the present invention for driving a pile member from an offshore installation, such as a tower;

FIG. 8 is a schematic illustration of the apparatus according to FIG. 7 driving a pile member for an underwater oil storage tank;

FIG. 9 is a top view illustrating further details of the gimble ring structure of the apparatus illustrated in FIGS. 7 and 8.

DESCRIPTION OF THE PREFERRED EMBODIMENTS

Figure 1:
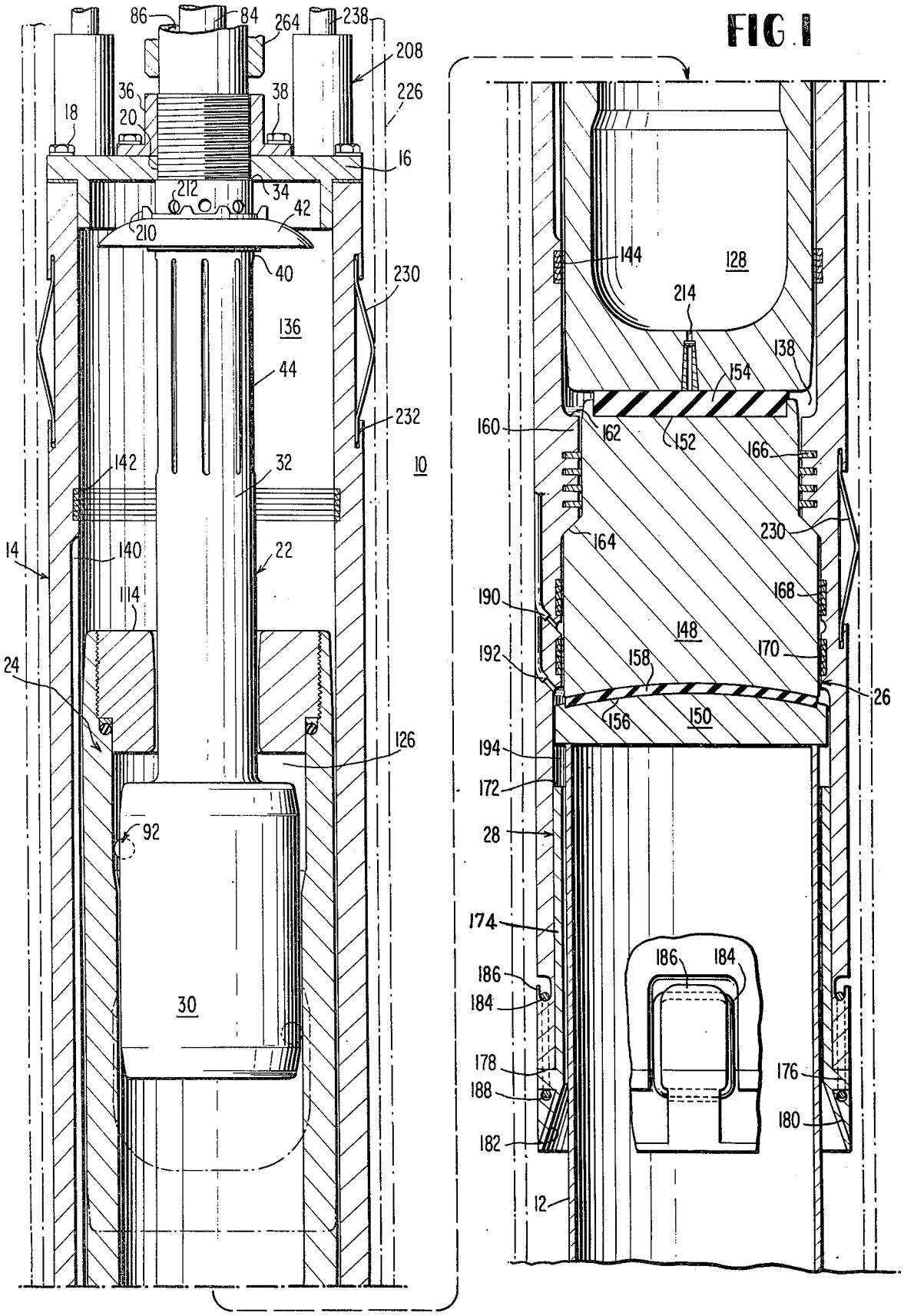
FIG. 1 is a partial longitudinal cross-sectional view taken through a pile driving hammer according to the present invention.

Turning to FIG. 1, there is shown a pile driving hammer 10 for driving a pile member 12. The pile driving hammer 10 includes a heavy elongated outer cylinder forming a housing member 14, through one end of which the pile member 12 is received, at the other end of the housing member 14 a closure plate 16 is fastened by a plurality of fastening bolts 18. The closure plate 16 includes a central opening 20 through which one end of a stationary piston structure 22 passes for mounting within the pile driving hammer 10. An elongated cylindrical ram structure 24 and an anvil structure 26 are mounted within the housing member 14 for longitudinal displacement relative to the housing member. In its rest position, the ram structure 24 is supported by the anvil structure 26, while the anvil structure 26 either engages a pile member, such as the pile member 12, or it engages and is supported by a guide sleeve 28.

The pile member 12 shown in FIG. 1 is a cylindrical pile member. However, it should be understood that any configuration of a pile member can be driven by the pile driving hammer 10.

The piston structure 22 includes a main body portion 30 and an elongated stem portion 32, which is preferably an integral extension of the main body portion 30. The stem portion 32 has a shoulder 34 which abuts against the underside of the closure plate 16 and serves as a stop in the assembly of the stem portion 32 to the closure plate 16. That portion of the stem portion 32 immediately above the shoulder 34 is preferably threaded for engagement with the threads provided on the inner surface of a split lock nut 36. The split lock nut 36 is, in turn, mounted to the closure plate 16 by fastening bolts 38. The stem portion 32 also includes the shoulder 40 against which an umbrella-like valve plate 42 rests. Below the shoulder 40, there are provided on the stem portion 32 a plurality of flutes or bypass channels 44 which extend preferably longitudinally in the direction toward the main body portion 30, but not for the whole length of the stem portion 32. The function of both the valve plate 42 and the flutes 44 is described more fully hereinafter.

Figure 2:
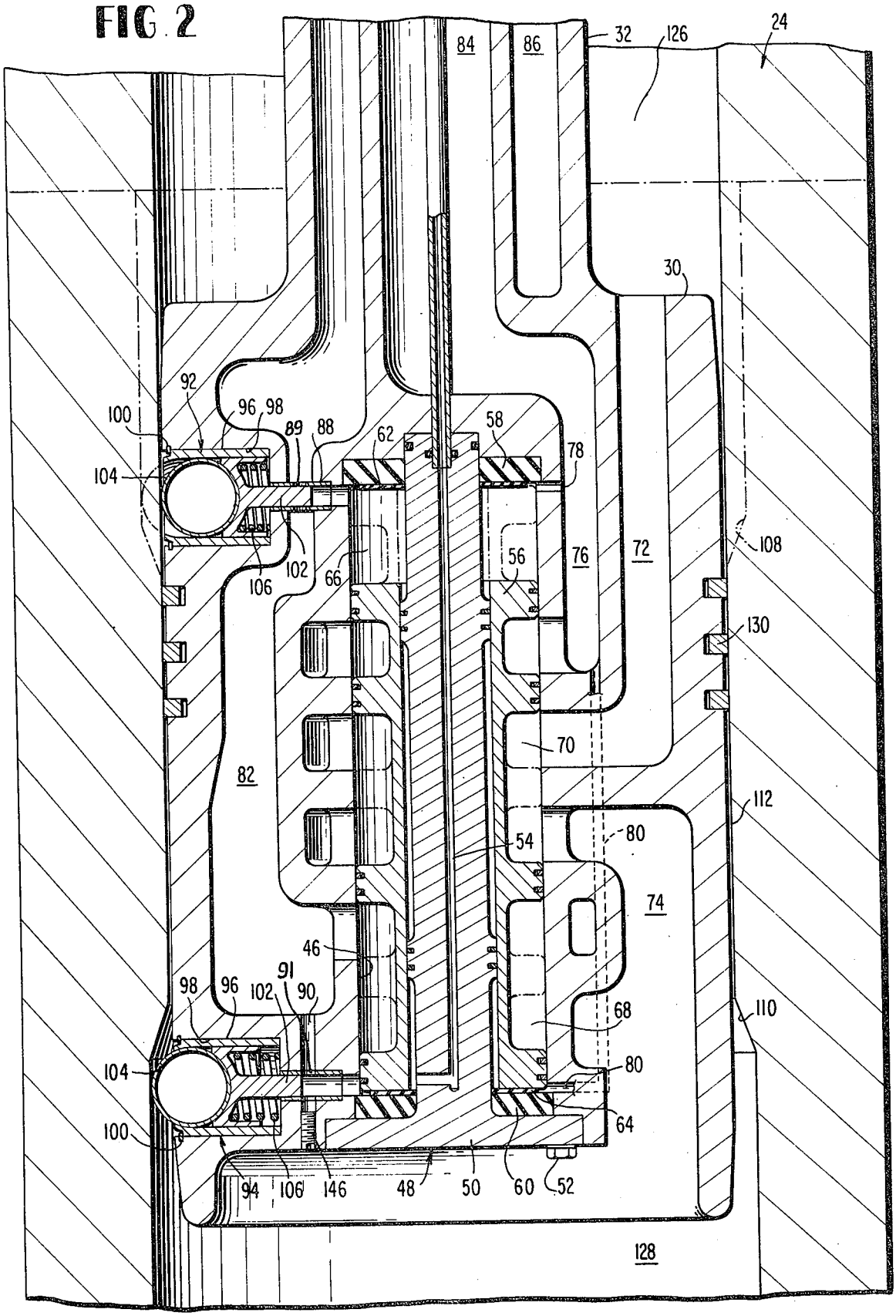
FIG. 2 is a cross-sectional view illustrating further details of the conduit means and valve means defined within the piston structure according to the present invention.
Figure 3:
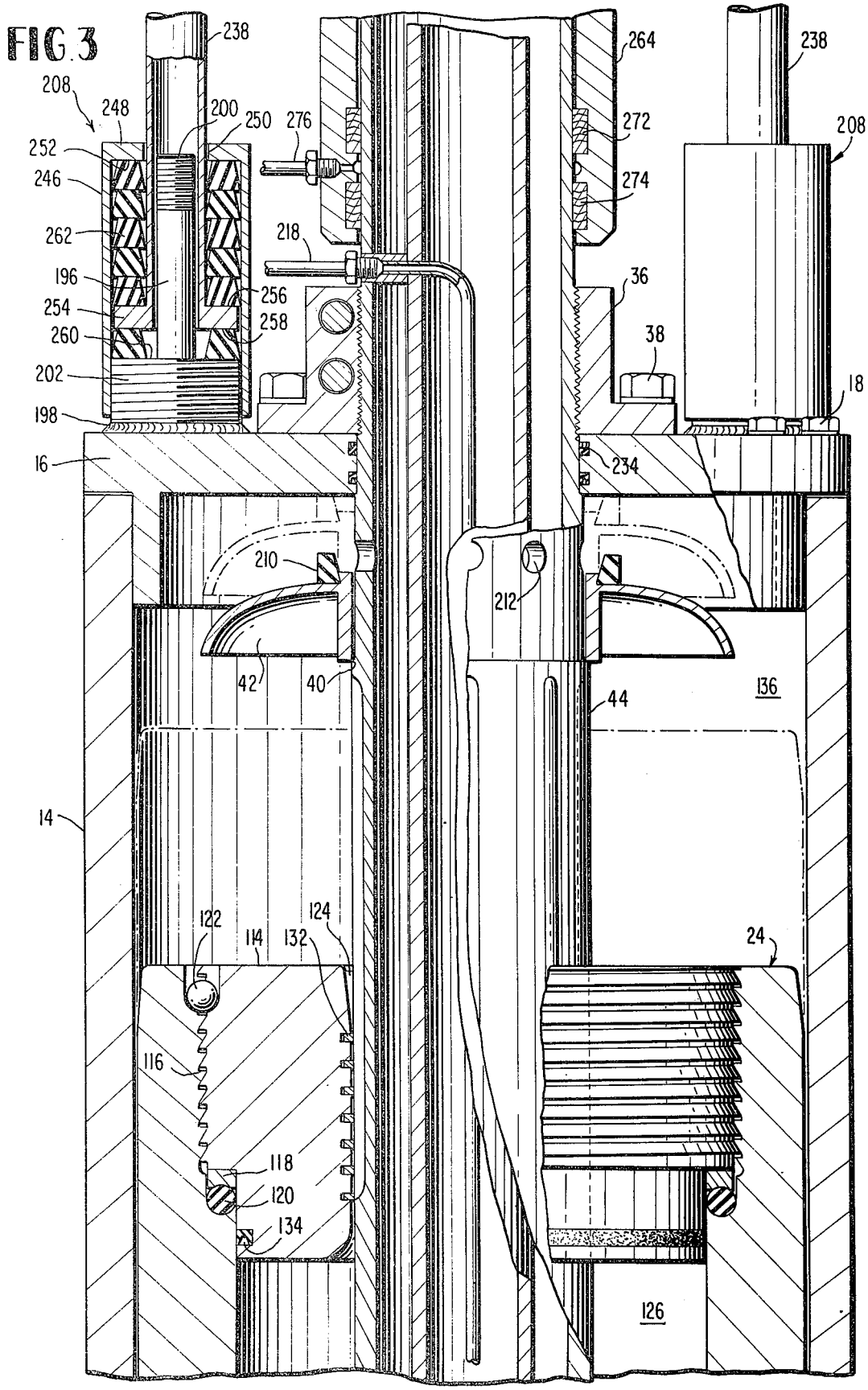
FIG. 3 is a partial cross-sectional view of the upper portion of the pile member driving hammer illustrated in FIG. 1 which illustrates the mounting for the piston structure, the mounting for the hammer, and details of the head portion of the ram structure.

The main body portion 30 is configured as shown in FIG. 2 to include a number of passages which serve to control the flow of a pressurized working fluid within the pile driving hammer 10. A central passage 46 is provided within which a spool valve 48 is mounted. The spool valve 48 includes a flanged central shaft 50 which is mounted by the fastening screws 52 to the main body portion 30. The central shaft 50 has a bore 54 therein, the purpose of which will be made clear hereinafter. The spool valve 48 also includes a displaceable sleeve 56 which is displaceable within the central passage 46 and along the longitudinal axis of the central shaft 50 between an upper cushion 58 and a lower cushion 60. These cushions can be made of a ductile material, such as rubber. To prolong the wear of the cushions 58 and 60, thin contact plates 62 and 64 are provided, which, in turn, are fastened by any conventional means, such as, for example, an adhesive, to their respective cushions 58 and 60. The central passage 46 and the spool valve 48 define a first chamber 66, a second chamber 68 and a third chamber 70. Also formed within the main body portion 30, are a first passage 72, a second passage 74, a third passage 76, a fourth passage 78, a fifth passage 80 and a sixth passage 82. As can be seen from FIG. 2, the third chamber 70 connects the first passage 72 with the third passage 76 when the displaceable sleeve 56 is in its uppermost position (first position), shown in dashed lines; and connects the first passage 72 with the second passage 74 when the displaceable sleeve 56 is in its lower position (second position) as shown in FIG. 3. Also, the fourth passage 78 connects the third passage 76 with first chamber 66, and the fifth passage 80 connects the third passage 76 with the second chamber 68.

In conjunction with these passages, conduit means are provided for both delivering to and exhausting from the main body portion 30 the pressurized working fluid. Preferably, the conduit means is formed as a pair of concentric tubes 84 and 86. The tube 84 serves as an inner delivery tube, while the tube 86 serves as an outer exhaust tube. As can be seen from FIG. 2, the inner tube 84 is connected to the third passage 76, while the outer tube 86 is connected to the sixth passage 82.

Further details of the tubes 84 and 86 externally to the pile hammer 10 are discussed below.

With the configuration shown in FIG. 2, the main body portion 30 is further provided with bores 88 and 90, which connect the first chamber 66 and the second chamber 68, respectively, to the sixth passage 82. Access to the first chamber 66 and the second chamber 68 through the bores 88 and 90 is controlled by ball valves 92 and 94. The ball valves 92 and 94 are identical and include an outer sleeve 96 which is received within a bore 98 within the main body portion 30 and retained therein by snap ring 100. Within the sleeve 96 a generally T-shaped stem 102 and a ball 104 are retained in assembly by a spring 106. The stem 102 extends into the bore 88 for the ball valve 92 and into the horizontal portion of the bore 90 for the ball valve 94, thereby controlling the access mentioned above. The valves 92 and 94 are normally biased outwardly by the springs 106 into their open position and may be shifted inwardly into their closed position by the engagement of the balls 104 with the cam surfaces 108 and 110 formed on the inside wall of the ram structure 24. Between the cam surfaces 108 and 110 there extends the wall 112. When the balls 104 engage the surface 112, the valves 92 and 94 are closed so that access from the first chamber 66 and the second chamber 68 to the sixth passage 82 is interrupted.

The valve plate 42 constitutes a first valve means, the spool valve 48 constitutes a second valve means, and the ball valves 92 and 94 together constitute a further valve means for controlling the flow of pressurized working fluid within the pile driving hammer 10.

The ram structure 24 is closed at one end and opened at its other end. At its open end, the ram structure 24 has mounted thereto a removable head 114. Details of the removable head 114 are shown most clearly in FIG. 3. As can be seen, the head 114 is held in the ram structure 24 by inverted buttress threads 116. The head 114 is tightened against a washer 118 and a wire rope cushion 120. A small amount of downward play in the threads 116 is provided in order to allow the cushion 120 to absorb the high shock loads of impact. To keep the head 114 from becoming unscrewed, a ball lock 122 is provided. The head 114 has a through-bore 124 through which the stem portion 32 extends.

The ram structure 24, when configured as described above, and when provided with the head 114, defines an internal space into which the main body portion 30 and a part of the stem portion 32 of the piston structure 22 extends. Within the internal space of the ram structure 24, the piston structure 22 defines a loading chamber 126 and a firing chamber 128. To ensure that an effective fluid separation shield is provided between these chambers, expanding ring seals 130 are mounted with the wall of the main body portion 30. Also with respect to the removable head 114, contracting seal rings 132 are mounted within the wall forming the through-bore 124, while a seal 134 is mounted within a slot provided in the surface of the head 114 which engages with the inner wall of the ram structure 24.

The ram structure 24 defines along with the housing member 14 and the closure plate 16 a secondary loading or expansion chamber 136 (further chamber), while the ram structure 24, the housing member 14 and the anvil structure 26 define a compression chamber 138. Within the inner wall of the housing member 14, there are formed a plurality of flutes or bypass channels 140, which provide a fluid passage from the bottom side of the ram structure 24 to the top side thereof. V-seals 142 and 144 are mounted within the wall of the housing member 14 at the two ends of the flutes 140.

As can be seen in FIG. 2, the first passage 72 opens into the loading chamber 126 and the second passage 74 opens into the firing chamber 128. Further access means are provided to the firing chamber 128 from the main body portion 30 in the form of plugs 146 which include Weep-holes therein through which condensation in the sixth passage 82 is drained off into the firing chamber 128.

The anvil structure 26 includes an anvil block 148, which is displaceably mounted within the lower portion of the housing member 14, and an alignment plate 150. At the top surface of the anvil block 148, there is provided a depression 152 into which a cushion plate 154 is mounted. At the top surface of the alignment plate 150, there is provided a depression 156 into which a cushion plate 158 is mounted. The depression 156 and the cushion plate 158 are preferably configured to have convex surfaces. The bottom surface of the anvil block 148 is concavely shaped in order to match the convex surface of the cushion plate 158. The cushion plates 154 and 158 are preferably made from a ductile material, such as aluminum.

In the area of the anvil structure 26 the housing member 14 is provided with a shoulder portion 160 which defines a pressure surface 162 within the compression chamber 138. At the other end of the shoulder 160, there is defined an inclined abutment surface 164, which is engaged by a mating surface on the anvil block 148, when a pile member is in position as shown in FIG. 1. Within the wall of the shoulder portion 160, there are included a plurality of contracting seal rings 166, while in the enlarged diameter portion of the housing member 14 below the shoulder portion 160 there are provided two sets of adjacent V-seals 168 and 170.

When the alignment plate 150 is not in engagement with a pile member, it rests against a surface 172 of a guide sleeve 28.

The guide sleeve 28 includes an extended portion 174, one end of which defines the surface 172 and at the other end of which a flange portion 176 extends horizontally outwardly. The flange portion 176, in turn, defines an abutment surface 178 which engages the bottom surface of housing member 14. A truncated cone portion 180 extends downwardly from the flange portion 176 and defines a guide surface 182 which guides the pile member into the housing member 14 and into engagement with the abutment plate 150. The guide sleeve 28 is mounted to the housing member 14 by preferably four equally spaced wire rope slings 184 which are looped around flush hooks 186 formed in the body of the housing member 14 and channels 188 formed in the body of the guide sleeve 28. The flush hooks 186 and the channels 188 define aligned pairs of channel portions. The flush hooks 186 may be provided with safety wire holes (not shown) to ensure retention of the rope slings 184.

The housing member 14 includes a longitudinal groove into which lines 190 and 192 extend. The line 190 is connected to a high pressure grease supply and feeds this grease to V-seals 168 and 170, and the line 192 is connected to a pressure regulator and then to a high pressure source of fluid such as air (neither of which are shown) and provides high pressure air to the vicinity of the alignment plate 150. This high pressure air forms an air pocket in the vicinity identified by the numeral 194 and is utilized when the pile driving hammer 10 serves to drive a pile member under water so as to ensure that impacting takes place against a cushion of air and not against water.

Turning again to FIG. 3, suspension bolts 196 are welded at 198 to the upper surface of the closure plate 16 at preferably four equidistant locations on the closure plate. The suspension bolts 196 are provided with threaded portions 200 and 202. The threaded portions 200 are provided for attachment of a bail member 204 (see FIG. 6), which, in turn, is connected to, for example, a crane hook block 206 (also FIG. 6). Alternatively, a frame structure can be connected to the pile driving hammer 10 by shock enclosure nuts 208. The shock enclosure nuts 208 are threadedly engaged with the threaded portion 202. The shock enclosure nuts 208 and the frame structure are discussed in further detail below.

MODE OF OPERATION

The pile driving hammer 10 can be utilized to drive a pile member in either onshore or offshore installations. For the onshore installation, a suitable guide structure such as the leads frame, disclosed in my U.S. Pat. No. 3,747,689, issued July 24, 1973, can be employed. In this case, it is only necessary to supply appropriate guide structure to the housing member 14 so as to make it adaptable for use with the leads frame. Appropriate apparatus for guiding and suspending the pile driving hammer 10 for offshore operations is described more fully hereinafter.

In either case, the pile driving hammer 10 is initially lowered onto the pile member to be driven. The pile member first engages the guide surface 182 and is thereby guided within the guide sleeve 28 and against the bottom surface of the alignment plate 150. The pile driving hammer 10 is lowered over the top of the pile member until the inclined abutment surface 164 of the anvil block 148 is brought into engagement with the corresponding surface on the shoulder portion 160 of the housing member 14. In this position, the structure 24 is resting against the top surface of the cushion plate 154, while the bottom surface of the anvil block 148 is resting against the top surface of the cushion plate 158 (FIG. 1). The pile driving hammer 10 is now ready for operation.

The working fluid is preferably pressurized air which can be obtained from a conventional air compressor stationed at the driving site. Pressurized air is delivered through the inner delivery tube 84 to the third passage 76 and the fourth passage 78 into the first chamber 66; and further through the fifth passage 80 into the second chamber 68. Since the ball valve 92 is in an open position while the ball valve 94 is in a closed position by virtue of the surface 112, the pressurized air moves through the first passage 78 to the chamber 66 as stated above, and then out the bore 88 and the holes 89 to the outer exhaust tube 86. Since the bore 88 is much larger than the passage 78, no pressure build-up will develop. At the same time, the pressurized air is retained within the second chamber 68 and causes the displaceable sleeve 56 to move against the contact plate 62 and upper cushion 58 (shown in dashed lines in FIG. 2) into its first position. In this position, the third passage 76 is now connected to the first passage 72 by the third chamber 70. As a result, pressurized air now flows in a first direction into the loading chamber 126. The pressurized air in the loading chamber 126 lifts the ram structure 24 toward the closure plate 16. When the contracting ring seals 132 pass over the flutes 44, some of the pressurized air bypasses the removable head 114, moves further in the first direction and is delivered to the secondary expansion chamber 136. In the process of filling the chamber 136, the pressurized air acts against the valve plate 42 lifting it from the shoulder 40 and toward the bottom surface of the closure plate 16. Extending from the top of the valve plate 42 are cushion blocks 210 which strike the bottom surface of the closure plate 16. In its raised position, the valve plate 42 closes the plurality of holes 212 which would ordinarily provide access to the outer exhaust tube 86. In this condition, pressure builds up in the chamber 136 which tends to slow the upward movement of the ram structure 24. At that point in time when the ball valve 92 engages the cam surface 108 and the ball valve 94 engages the cam surface 110, while the ram structure 24 is being lifted, the condition within the spool valve 48 begins to change, so that when the valve 94 ceases to engage the surface 112, it opens. Simultaneously, the valve 92 engages the surface 112 and closes. This results in draining of the pressurized air in the second chamber 68 through the holes 91 and charging of the first chamber 66. With this, the displaceable sleeve 56 shifts downwardly as shown in FIG. 2, closing off communication between the third passage 76 and the first passage 72, and establishing communication between the first passage 72 and the second passage 74 through the third chamber 70. In this condition, some of the pressurized air in the loading chamber 126 passes through the first passage 72, the third chamber 70 and the second passage 74 to the firing chamber 128. Redirecting the pressurized air in a second direction into the firing chamber 128 causes the ram structure 24 to move downwardly toward the anvil structure 26 into its second position. Initially, the pressurized air in the secondary expansion chamber 136 assists the movement of the ram structure 24 in the downward direction.

As the ram structure 24 descends in the direction of the anvil structure 26, it passes the V-seals 142 and causes communication to be established between the flutes 140 and the chamber 136. As a consequence, air is free to move from under the ram structure 24 through the flute channels 140 and to the chamber 136. The air in the chamber 136 now passes out through the holes 212 into the outer exhaust tube 86, the holes 212 being opened as a result of the valve plate 42 dropping to a thrust position against the shoulder 40. The valve plate 42 drops when pressurized air ceases to flow into the chamber 136 from the flutes 44. The air from under the ram structure 24 continues to flow through the flute channels 140 into the chamber 136 until the ram structure passes the V-seals 144. At this point the compression chamber 138 is formed by the housing member 14, the ram structure 24 and the anvil structure 26. As the ram structure 24 continues to descend into the compression chamber 138, its potential energy compresses the air contained therein and develops a preload force against the anvil structure 26 and the pressure surface 162. The preload against the anvil structure 26 begins to move the anvil structure downwardly before impact occurs between the ram structure and the anvil structure. In effect, this amounts to a reduction in the velocity of the ram structure 24. Thereafter the impact occurs against the cushion plate 154.

The reduced velocity accompanied by a preload force is a much more effective means of energy transfer than that of an ordinary impact load. Further, striking a softer material, that is the cushion plate 54, which is made of a soft material, such as aluminum, aids in absorbing energy from the ram structure 24 without rebounding high frequency shock waves which cause metal fatique.

The preload force against the pressure surface 162 also serves to force the housing member 14 down firmly against the abutment surface 164 thus causing it to follow the anvil structure 26 during the impacting period of the ram structure.

After impacting, the ball valve 94 is once again closed while the ball valve 92 is opened causing the displaceable sleeve 56 to shift in the upward direction. In view of this shifting, and the unspent energy in the compression chamber, the ram structure is again directed to the first direction toward the closure plate 16. In this and subsequent cycles when the V-seals 142 are covered by the ram structure 24, a partial vacuum is formed under the ram structure. This partial vacuum acts like a tension spring that retards the upward movement of the ram structure and accelerates its downward movement resulting in a greater impact velocity.

Any water condensation from the air which is preferably used as the working fluid may pass through plugs 146 and into the chamber 128 and from there through a flexible disc valve 214 situated in the closed end of the ram structure 24 during the pressure changes that occur. The condensation is then drained down around the anvil structure 26 and is forced out along with the blow by air that escapes past the rings 166 and the V-seals 168 and 170 during compression.

Figure 4:
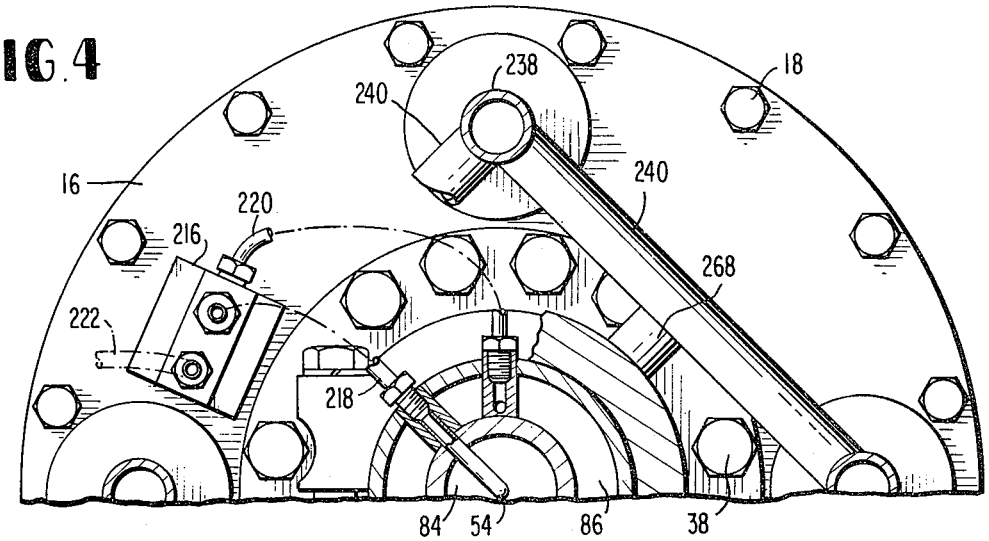
FIG. 4 is a partial top view, partially in cross section, taken along the line 4—4 of FIG. 3.
Figure 5:
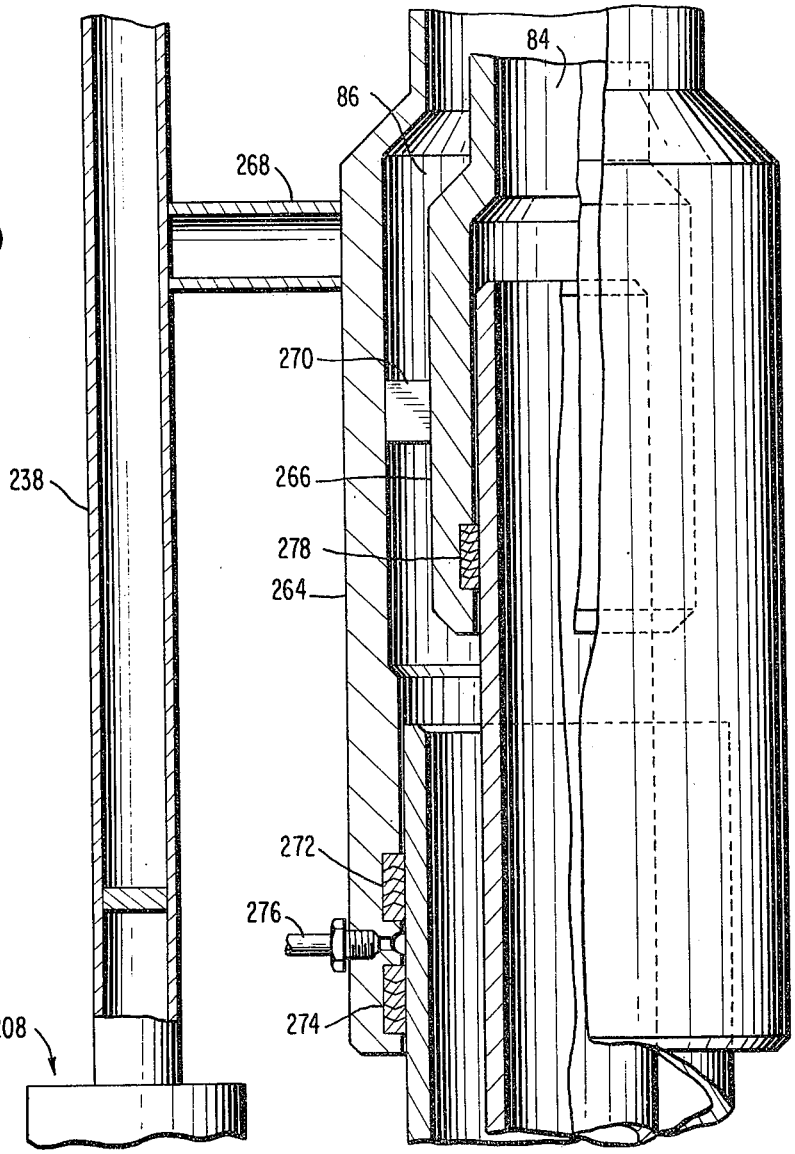
FIG. 5 is a cross-sectional view illustrating further details of the conduit means and its connection to the piston structure.

It is possible, if desired, to short-stroke the pile driving hammer 10 or stop it through the use of secondary means in the form of a solenoid valve 216 and associated connecting lines. This valve is mounted to the top of the closure plate 16 (FIG. 4) from which lines 218, 220 and 222 extend. The line 218 is connected to the bore 54 which, in turn, extends down through the spool valve 48 to the second chamber 68. A line 220 is connected to the outer exhaust tube 86 and a line 222 is an electrical line for supplying electrical power for operating the valve 216. It should be noted that during the operation described above, the solenoid valve 216 is closed. However, to short-stroke or stop the pile driving hammer 10, the valve 216 is energized which means that pressurized air which is fed into the second chamber 68 is bled off through the bore 54, the line 218, the valve 216 and the line 220 to the outer exhaust tube 86. In this way, the displaceable sleeve 56 is shifted downwardly, thereby controlling the stroke or extent of the upward advance of the ram structure 24.

If the hammer 10 is to be used as a more or less single-acting hammer, the V-seals 142 and 144 are removed as well as the valve plate 42.

OFFSHORE APPLICATIONS

For driving a pile member under water, I prefer to have the pile driving hammer follow the pile member being driven into the water, because the most efficient way of driving a pile member is to retain immediate contact between the pile driving hammer and the pile member. In order to accommplish this purpose it is necessary to shield the pile driving hammer from the water, and for this purpose a conveyor means which defines a passage through which the pile member and the pile driving hammer with its associated structure is passed in the course of driving the pile member. The associated structure must be capable of retaining the pile driving hammer in driving engagement with the pile member.

According to one application of the present invention, the pile member, such as the pile member 12, can be driven from an offshore installation, such as a tower 224 (FIG. 6). The tower includes at least one jacket leg 226 which serves as the conduit means defining the passage through which the pile member 12 and a pile driving hammer pass in the course of driving the pile member. Initially the pile member 12 is provided with a suitable number of centering lugs 228, in order to ensure that the pile member is retained in a proper centered position within the jacket leg 226. The pile member 12 is inserted into the jacket leg 226 and then the apparatus including the pile driving hammer and its associated structure are guided into the jacket leg 226, with the pile driving hammer being guided over and into position against the pile member 12.

The pile driving hammer can be similar to the pile driving hammer 10 desribed above, or it can be any other type of pile driving hammer which is adapted for reception within the jacket leg 226. Preferably, however, the pile driving hammer 10 is used. For guiding the pile driving hammer 10 within the jacket leg 226, a suitable number of centering springs 230 are fastened to the outer surface of the housing member 14 at both an upper and lower station as shown in FIG. 1. The centering springs 230 are mounted to the outer surface of the housing member 14 by slots 232 into which the ends of the centering springs are received and retained. For offshore operations, the closure plate 16 is provided with seals 234 which engage with the stem portion 32 of the piston structure 22 in order to seal off water around the stem portion 32.

The apparatus associated with the pile driving hammer 10 for use in driving a pile member through a jacket leg 226 preferably comprises a frame structure 236 which includes preferably four vertically directed pipes 238 and horizontal beams 240, with diagonal reinforcing beams (not shown) provided, if necessary. The frame structure is preferably developed as a composite of individual sections of any desired height. The individual sections are detachably connected to each other. At any given time, the uppermost sections have the bail 204 connected to the pipes 238 by suitable pipe joining unions 242. The bail is then connected to the crane hook block 206 which, in turn, is attached to a cable 244 of the crane. The crane itself may be positioned on the tower 224 or on a barge floating adjacent to the tower. The initial section of the frame structure 236 is mounted to the closure plate 16 through the use of the shock enclosure nuts 208 (FIG. 3). These nuts include an outer cap housing 246 which is internally threaded at its lower open end for engagement with the threads 202 of the suspension bolts 196. At its opposite end, the cap housing 246 includes a closure wall 248 with a central bore through which the pipe 238 extends. The wall 248 defines an internal abutment surface 252. Further abutment surfaces are defined by a flange 254 extending horizontally outwardly from the end of the pipes 238 and by the lower portion of the suspension bolts 196. The surfaces defined are those indicated by the numerals 256, 258 and 260. Within the cap housing 246 and between the abutment surfaces, there is located a plurality of annular rings 262 which are preferably made of rubber. As can be seen from FIG. 3, the shock enclosure nuts 208 permit relative movement between the pile driving hammer 10 and the frame structure 236.

In order to continue the concentric tube arrangement of the working fluid conduit means, the end of the stem portion 32 which extends outwardly from the lock nut 36 is provided with slip-on extensions 254 and 266. These extensions are suitably shaped for providing a continuation of the inner delivery tube 84 and the outer exhaust tube 86. Preferably, these extensions are connected to and extend along the individual frame structures. For example, the slip-on extension 264 can be connected to at least one of the horizontal beams 240 by connecting struts 268, while the slip-on extension 266 can be connected to the slip-on extension 264 by a desired number of connecting struts 270. Both of the slip-on extensions 254 and 266 are appropriately sealed to the pipes to which they are connected. The extension 264 is provided with the oppositely directed V-seals 272 and 274, which are greased-fed through the line 276, while the extension 266 is provided with V-seals 278. At the upper end of each frame section to which the bail 204 is connected, the slip-on extension 266 is connected, in a conventional manner, to a source for the working fluid, which I prefer to be compressed air. The source itself may be located on the tower or barge, as the case may be.

With the apparatus as assembled above, a pile member 12 can be very easily driven through the jacket leg 226 with a direct contact being maintained between the pile driving hammer 10 and the pile member 12, it only being necessary to add additional sections of the frame structure 236 as necessary. The pile driving hammer 10 functions as described above.

In a further application of the present invention, it may be desirable to drive the pile member 12 not through a jacket leg of a tower, but rather through a unique hammer guide and pile member feeder tube 278 (FIGS. 7, *7a*, *7b*, *7c* and *7d*) in conjunction with the pile driving hammer 10 and the frame structure 236. The hammer guide and pile member feeder tube 278 includes the hammer guide portion 280 and the pile member feeder portion 282. The varying shape of the tube 278 can be seen by the various views shown in FIGS. *7a–7d*. The pile member feeder portion 282 is provided with a feeder funnel 284 to assist in making pile member entry into the pile member feeder portion 282. At the section shown in FIG. *7c*, the hammer guide portion 280 is provided with three centering springs 286 for centering the freestanding pile member 12 after it has been dropped into position through the pile member feeder portion 282. In this way, the pile member 12 can be readily inserted into the guide sleeve 28 of the pile driving hammer 10. The tube 278 is held by a loose-fitting sleeve 288 which, in turn, is mounted to a four-way movement gimble ring 290. The gimble ring 290 is itself mounted to lugs 292 on the barge 294. The mounting lugs 292 which mount the gimble ring 290 are located on a portion of the barge 296 which provides direct access from the barge into the water so that the tube 278 can be pivoted as shown in FIGS. 8 and 9.

Figures 7, 7A, 7B, 7C, 7D:
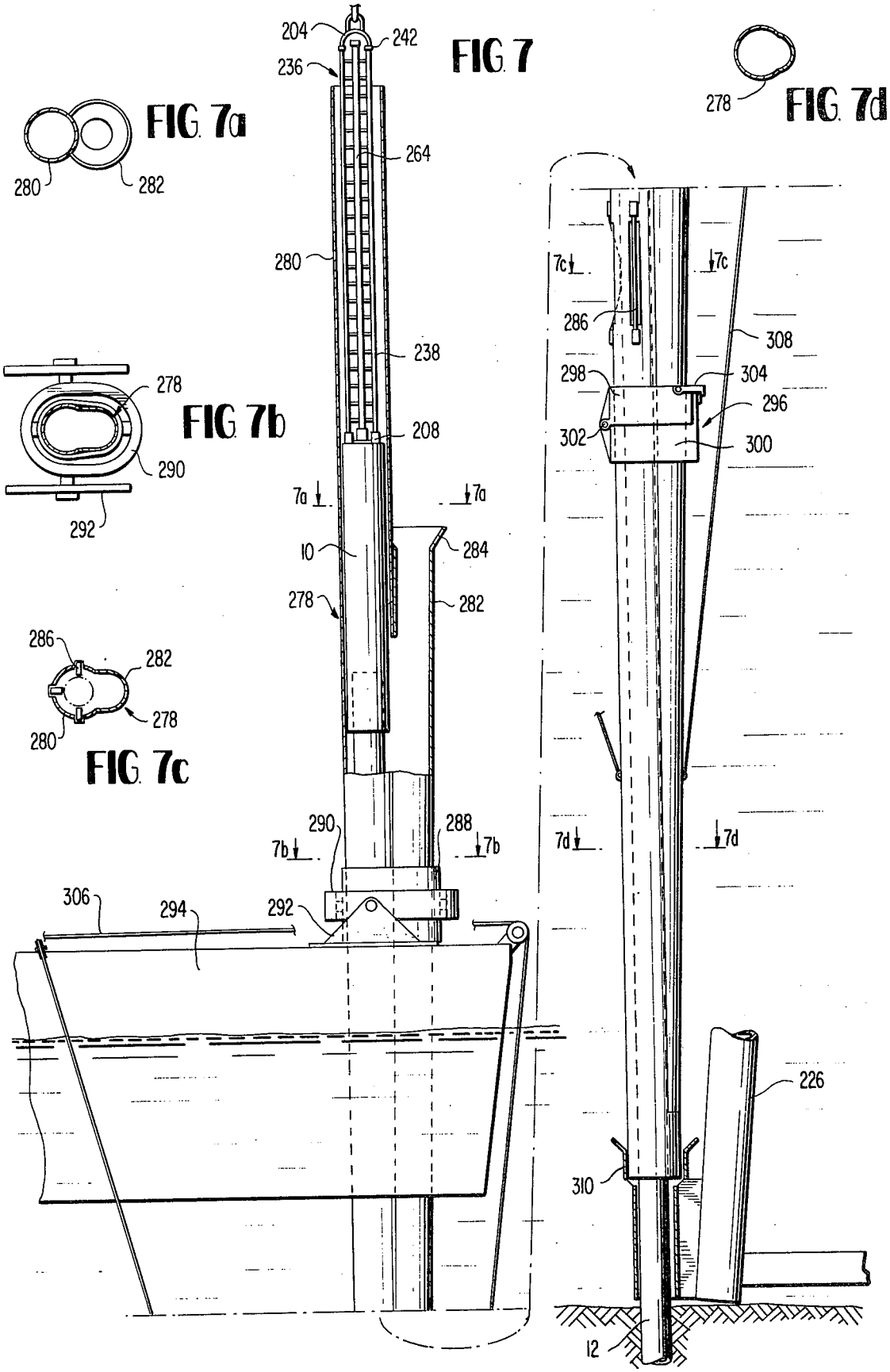
FIG. 7 is a schematic illustration of an apparatus according to the present invention for driving a pile member from an offshore installation, such as a floating barge, the apparatus including a hammer guide and pile member feeder structure.
FIGS. 7*a*, 7*b*, 7*c* and 7*d* illustrate various cross-sectional views of the hammer guide and pile member feeder structure.

Preferably, the tube 278 is made in two sections which are jointed by the hinge joint 296 as shown in FIG. 7. The hinge joint 296 is formed by the jaws 298 and 300 jointed together by the pin 302 and held in engagement by the latch 304. With this arrangement, the tube 278 can be carried by the barge 294. For example, the hinge joint 296 can be broken and the lower section pulled up by the control lines 306 and 308 and mounted in a saddle (not shown) on the barge 294, while the top portion is layed down on the deck of the barge. In use, as shown in FIG. 7, the tube 278 is lowered into the jacket leg anchor sleeve 310 by the control lines 306 and 308. The tube 278 is then tilted backwards into a position such as that shown in FIG. 8 and a pile member inserted into the pile member feeder portion 282. The pile member is then allowed to fall in place with the pile head being centered by the centering springs 286. The pile driving hammer 10 with an appropriately connected section of the frame structure 236 is then lowered through the pile driving hammer guide portion 280 so that the pile member will pass into the sleeve 28 and in position for being driven.

FIGS. 8 and 9 illustrate an application of the present invention utilizing the tube 278 for driving anchor pile members for oil storage tanks 312. The tank includes a riser tube 314 which is used to anchor the barge 294 in position for driving. To anchor the barge 294, a guide 316 is mounted to the barge which defines a space for receiving the riser tube 314. The tube 314 is held in this space by a line 318.

Figure 10:
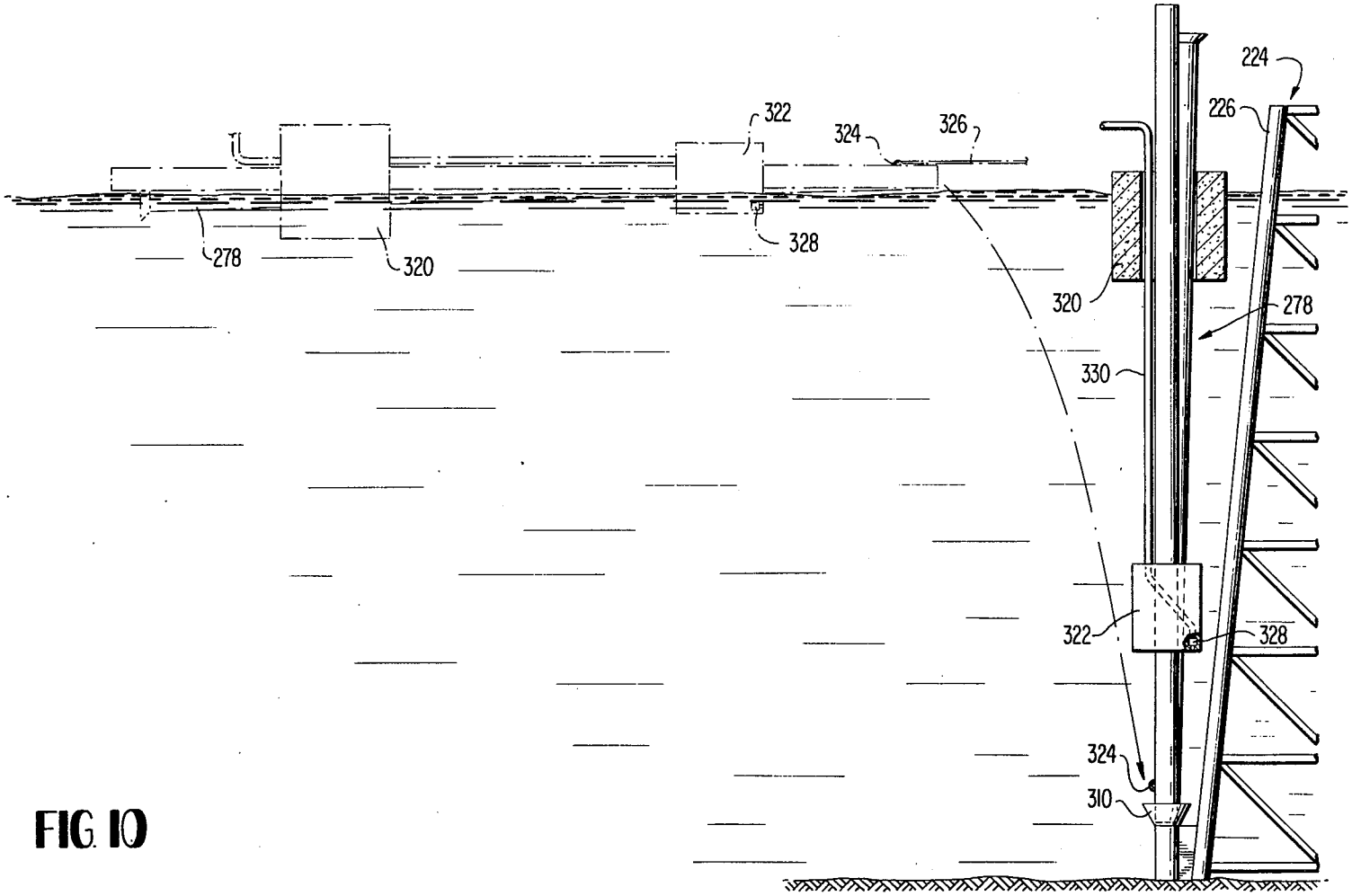
FIG. 10 is a schematic illustration of an apparatus used in conjunction with an offshore installation for driving a pile member.

FIG. 10 illustrates still another application of the present invention utilizing the tube 278. In this figure, the tube 278 is transported by the buoys 320 and 322. The buoy 320 can slide along the tube 278 while buoy 322 is fixed. Near the lower end of the tube 278, that is the end which is received within the anchor sleeve 310, a hook 324 is mounted, to which a tow line 326 is attached for towing the tube 278 with the buoys 320 and 322 to the driving site. At the driving site, the fixed buoy 322 is flooded by actuating flood valve 328 through the air line 330. This causes the buoy 320 to sink the lower end of the tube 278 while the buoy 320 remains afloat. Since the buoy 320 is slidable, it can compensate for wave motion. To float the lower end of the tube 278 or to lift it, the float valve 328 is closed and air is pumped down the air line 330. The crane for suspending the pile driving hammer and its associated structure, can be stationed on the tow barge or on the tower 224.

For long tubes 278, it may be necessary to have more than one fixed buoy 322.

In all of the offshore applications, an air pocket 194 is maintained, as pointed out above, so that the anvil structure moves against air instead of water. The air cushion improves the efficiency of the blow because it eliminates the hydraulic effect that would be caused when the anvil structure strikes the non-compressible water.

SUMMARY OF EXEMPLARY ADVANTAGES

The pile driving hammer, apparatus and method, described above, possess some of the following exemplary advantages:

1. a long one-piece heavy outer cylindrical housing member that encloses the ram structure, the anvil structure, the air pocket in the vicinity of impact, and supports the pile member alignment sleeve.

2. A pile drivng hammer that operates in a double-acting compound air mode (double expansion of the power air) or in a single acting mode (power air lifts the ram structure and is then exhausted). Further, in the double-acting compound air mode, a vacuum pull below the ram structure is utilized on the upstroke to accelerate the downstroke.

3. A pile driving hammer which defines a compression chamber at the bottom portion of its downstroke in which a preload is developed which is supplied against the anvil structure and causes it to move downwardly but at a slower rate than the ram structure. This occurs just before impact and results in improving the transfer of energy to the pile member as well as an increased life for the cushion members of the anvil structure. This feature also reduces the fatique in the ram structure.

4. A pile driving hammer which is self-purging and will expel water accumulation from condensation and possible leakage. The preload mentioned above forces the condensation and possible leakage out of the pile driving hammer.

5. A pile driving hammer which utilizes the preload mentioned above to ensure that the ram structure does not overdrive the anvil structure. To accomplish this, a shoulder is provided at the bottom of the compression chamber against which the preload acts to cause the housing member to follow the anvil structure. This eliminates the need of long cable or bolt-type tie rods between the housing member and the anvil structure.

6. A pile driving hammer which has an air pocket in the vicinity of impact with the advantages mentioned above.

7. A pile driving hammer with a system of double seals around the anvil structure (contracting seal rings and V-seals). The ring seals protect the V-seals from the high pressure shocks, while the V-seals seal against the skirt pressure below the anvil structure. The V-seals are fed teflon grease for lubrication. The teflon grease also adds to the sealing effect.

8. A pile driving hammer which can develop a preload of approximately 260 tons.

9. A pile driving hammer that possesses a unique conduit means for delivering and exhausting the working fluid from the hammer. The conduit means includes two concentric tubes which are formed integral with the piston structure of the hammer. Preferably the exhaust tube surrounds the delivery tube so as to act as an insulator against the environment, especially during offshore operations.

10. A pile driving hammer with means for controlling the stroke of the ram structure or even stopping it.

11. Apparatus in the form of a system of extensible frames that support the pile driving hammer for offshore operation. Preferably the extensible frames also include extensions of the concentric delivery and exhaust tubes.

12. A pile driving hammer that will operate on commercially available air compressors that deliver up to 150 psig.

13. A pile driving hammer with a high shock impedance.

14. A unique hammer guide and pile member feeder tube for use with the pile driving hammer during offshore operations.

15. A system for driving a pile member from an offshore installation which may be a tower, a floating barge, or even a system of buoys.

That which is claimed is:

1. An apparatus for driving a pile from an offshore installation, the installation including a structure having at least one conveyor means which extends below the surface of the water, the conveyor means defining a passage therethrough for the reception of a pile member to be driven, the apparatus comprising:

a. a pile driving hammer including an elongated housing member, means mounted to said housing for guiding said hammer within the passage of said conveyor means and retaining the alignment of said hammer with respect to said conveyor means, anvil means which engage the pile member to be driven, and a pocket formed by the housing member and the anvil means in the area of engagement of the pile member and said anvil means into which a pressurized fluid is fed thereby displacing any water from the vicinity of engagement of the anvil means with the pile member to be driven;

b. a support structure mounted to said hammer for suspending said hammer throughout the span of its operation; and c. means suspending said support structure throughout the span of operation of said hammer.

2. The apparatus as defined in claim 1, wherein the structure is an offshore tower having a cylindrical tube as the conveyor means into which the pile member, the hammer and the support structure pass when drivng the pile member, and wherein said guide means engage the inner surface of the cylindrical tube at at least three locations around the circumference of the inner surface at at least two longitudinally displaced stations on the hammer.

3. The apparatus as defined in claim 1, wherein the structure is an offshore tower having a cylindrical tube as the conveyor means into which the pile member, the hammer and the support structure pass when driving the pile member, and wherein the pile member is provided with guide means which engage the inner surface of the cylindrical tube at at least three locations around the circumference of the inner surface.

4. The apparatus as defined in claim 1, further comprising shock absorbing means for mounting said support structure to said hammer.

5. The apparatus as defined in claim 1, wherein said support structure comprises a frame structure including a plurality of detachable segments.

6. The apparatus as defined in claim 1, wherein the structure is a barge having a hammer guide and pile member feeder tube as the conveyor means into which the pile member, the hammer and the support pass when driving the pile member, said barge including means for pivotably mounting said hammer guide and pile member feeder tube thereto, and means for lowering said hammer guide and pile member feeder tube from said barge and into the water.

7. The apparatus as defined in claim 6, wherein said hammer guide and pile member feeder tube are formed as a single tube which can simultaneously receive both said hammer and the pile member to be driven, said hammer guide and pile member feeder tube having a portion which receives the pile member to be driven and aligns same with respect to said hammer.

8. The apparatus as defined in claim 6, wherein said hammer guide and pile member feeder tube includes centering means for centering the pile to be driven as it is fed into said hammer guide and pile member feeder tube with respect to said hammer.

9. The apparatus as defined in claim 6, wherein said hammer guide and pile member feeder tube are formed in two sections, and wherein said apparatus further includes means for latching said two sections into assembled position preparatory to driving a pile member, said two sections being of sufficient length for storage and transport on the barge.

10. The apparatus as defined in claim 1, wherein the structure comprises a plurality of buoyant structures positioned along the length of a hammer guide and pile member feeder tube which serves as the conveyor means into which the pile member, the hammer and the support pass when drivng the pile member, wherein at least one of said buoyant structures is caused to sink in order to position said hammer guide and pile member feeder tube at the pile driving site.

11. The apparatus as defined in claim 10, wherein one of said buoyant structures is slidable along the length of said hammer guide and pile member feeder tube and wherein means are provided for controlling the air content of said at least one buyoant structure in order to control the floating and sinking thereof.

12. The apparatus as defined in claim 1, wherein that portion of the housing member which defines the pocket extends from substantially adjacent that portion of the anvil means in engagement with the pile to the open end thereof.

13. A method of producing a reciprocating impact load against a pile member by a fluid actuated pile member driving hammer, comprising the steps of:

a. supporting the pile member in position to be driven;
b. supporting the hammer relative to the pile member in a position aligned with the pile member for delivering to the pile member a reciprocating impact load;
c. directing a pressurized working fluid in a first direction in the hammer to cause a load delivering member to move in said first direction;
d. directing a portion of the pressurized working fluid further in the first direction to decelerate the movement of the load delivering member in said first direction;
e. directing another portion of the pressurized working fluid in a second direction in the hammer thereby causing along with step (d) the load delivering member to move in the second direction toward a load transferring member which is in engagement with the pile member;
f. compressing a fluid between the load delivering member and the load transferring member to preload the load transferring member to cause it to move in the second direction at a slower rate than the load delivering member;
g. impacting the load delivering member against said load transferring member, and
h. repeating steps (c) – (g) as desired.

14. The method as defined in claim 13, wherein each succeeding movement of the load delivering member in the first direction causes a partial vacuum to be developed in the space within the hammer between the load delivering member and the load transferring member thereby serving to retard movement of the load delivering member in the first direction and to accelerate its movement in the second direction.

15. The method as defined in claim 13, wherein the magnitude of said impact is controlled by controlling the displacement of the load delivering member in the first direction.

16. A method of producing a reciprocating impact load against a pile member to be driven offshore by a fluid actuated pile member driving hammer, comprising the steps of:

a. inserting the pile member within a conveyor means which extends below the surface of the water and supporting the pile member in position to be driven;
b. supporting the hammer relative to the pile member in a position aligned with the pile member for delivering to the pile member a reciprocating impact load, the hammer being displaceable within the conveyor means during the pile member driving operation;
c. displacing the water from the area immediately surround the plane of engagement of the pile member and a load transferring member of the hammer;
d. directing a pressurized working fluid in a first direction in the hammer to cause a load delivering member to move in said first direction;
e. direction a portion of the pressurized working fluid further in the first direction to decelerate the movement of the load delivering member in said first direction;
f. direction another portion of the pressurized working fluid in a second direction in the hammer thereby causing along with step (e) the load delivering member to move in the second direction toward a load transferring member which is in engagement with the pile member;
g. compressing a fluid between the load delivering member and the load transferring member to preload the load transferring member to cause it to move in the second direction at a slower rate than the load delivering member;
h. impacting the load delivering member against said load transferring member; and
i. repeating steps (d) – (h) as desired.

17. The method as defined in claim 16, wherein each succeeding movement of the load delivering member in the first direction causes a partial vacuum to be developed in the space within the hammer between the load delivering member and the load transferring member thereby serving to retard movement of the load delivering member in the first direction and to accelerate its movement in the second direction.

18. The method as defined in claim 16, wherein the magnitude of said impact is controlled by controlling the displacement of the load delivering member in the first direction.

19. An apparatus for driving a pile from an offshore installation, the installation including a structure having at least one conveyor means which extends below the surface of the water, the conveyor means defining a passage therethrough for the reception of a pile member to be driven, the apparatus comprising:

a. a pile driving hammer including an elongated housing member, means mounted to said housing for guiding said hammer within the passage of said conveyor means and retaining the alignment of said hammer with respect to said conveyor means, closure plate means, means mounting said closure plate means to one end of said housing, piston means, elongated ram means, anvil means which engage the pile member to be driven, and means for establishing an air pocket in the area of engagement of the pile member and said anvil means;
b. a support structure mounted to said hammer for suspending said hammer throughout the span of its operation;
c. means suspending said support structure throughout the span of operation of said hammer; and d. conduit means, wherein:
   i. said closure plate means includes means for mounting said piston means thereto so that said piston means extends into said housing;
   ii. said ram means defines an internal space into which is received a portion of said piston means which extends into said housing for defining therewith a loading chamber and a firing chamber which alternately receive from said piston means a pressurized working fluid for loading and then firing said ram means against said anvil means; and
   iii. said conduit means provides a path for the working fluid to said piston means, with said conduit means being mounted to said support structure.

20. The apparatus as defined in claim 19, wherein said support structure comprises a frame structure including a plurality of detachable segments, and wherein said conduit means is formed as concentric tubes connected at one end to said piston means and along their extent to said frame structure at a plurality of stations, with one of said tubes serving as a delivery tube for said pressurized working fluid and the other of said tubes serving as an exhaust for a portion of said pressurized working fluid.

21. The apparatus as defined in claim 20, wherein said delivery tube is the inner one of said concentric tubes.

22. An apparatus for driving a pile under water, comprising:
   a. a pile driving hammer including an elongated housing member, anvil means which engage the pile member to be driven, and a pocket formed by the housing member and the anvil means in the area of engagement of the pile member and said anvil means into which a pressurized fluid is fed thereby displacing any water from the vicinity of engagement of the anvil means with the pile member to be driven;
   b. a support structure mounted to said hammer for suspending said hammer throughout the span of its operation; and
   c. means suspending said support structure throughout the span of operation of said hammer.

23. The apparatus as defined in claim 22, wherein that portion of the housing member which defines the pocket extends from substantially adjacent that portion of the anvil means in engagement with the pile to the open end thereof.

24. An apparatus for driving a pile under water comprising:
   a. a pile driving hammer including an elongated housing member, closure plate means, means mounting said closure plate means to one end of said housing, piston means, elongated ram means, anvil means which engage the pile member to be driven, and means for establishing an air pocket in the area of engagement of the pile member and said anvil means;
   b. a support structure mounted to said hammer for suspending said hammer throughout the span of its operation;
   c. means suspending said support structure throughout the span of operation of said hammer; and
   d. conduit means, wherein:
      i. said closure plate means includes means for mounting said piston means thereto so that said piston means extends into said housing;
      ii. said ram means defines an internal space into which is received a portion of said piston means which extends into said housing for defining therewith a loading chamber and a firing chamber which alternately receive from said piston means a pressurized working fluid for loading and then firing said ram means against said anvil means; and
      iii. said conduit means provides a path for the working fluid to said piston means, with said conduit means being mounted to said support structure.

25. The apparatus as defined in claim 24, wherein said support structure comprises a frame structure including a plurality of detachable segments, and wherein said conduit means is formed as concentric tubes connected at one end to said piston means and along their extent to said frame structure at a plurality of stations, with one of said tubes serving as a delivery tube for said pressurized working fluid and the other of said tubes serving as an exhaust for a portion of said pressurized working fluid.

26. The apparatus as defined in claim 24, wherein said delivery tube is the inner one of said concentric tubes.

* * * * *